US008499365B1

(12) United States Patent
Hill

(10) Patent No.: US 8,499,365 B1
(45) Date of Patent: Aug. 6, 2013

(54) HELMET FOR COOLING HEAD

(76) Inventors: Eric J. Hill, Placentia, CA (US); Kimsiana Hill-Lathan, legal representative, Placentia, CA (US)

( * ) Notice: Subject to any disclaimer, the term of this patent is extended or adjusted under 35 U.S.C. 154(b) by 0 days.

(21) Appl. No.: 13/243,275

(22) Filed: Sep. 23, 2011

(51) Int. Cl.
*A42B 1/06* (2006.01)

(52) U.S. Cl.
USPC ..... 2/410; 2/413; 2/422; 2/171.2

(58) Field of Classification Search
USPC ..... 2/410, 413, 422, 425, 171.2
See application file for complete search history.

(56) References Cited

U.S. PATENT DOCUMENTS

| | | | | |
|---|---|---|---|---|
| D266,627 | S | 10/1982 | Gooding | |
| 4,354,284 | A | 10/1982 | Gooding | |
| 4,566,455 | A * | 1/1986 | Kramer | 607/109 |
| 4,711,099 | A * | 12/1987 | Polan et al. | 62/457.4 |
| 4,753,242 | A | 6/1988 | Saggers | |
| 5,557,807 | A | 9/1996 | Hujar et al. | |
| 6,625,820 | B1 | 9/2003 | Lampe | |
| 7,222,380 | B2 | 5/2007 | Chen | |
| 7,509,692 | B2 * | 3/2009 | Elkins et al. | 2/458 |
| 7,694,353 | B2 * | 4/2010 | Weston | 2/171.3 |
| 2004/0060100 | A1 | 4/2004 | Reiterman | |
| 2005/0028253 | A1 | 2/2005 | Fowler | |
| 2009/0032049 | A1 * | 2/2009 | Rabin et al. | 132/270 |
| 2010/0319110 | A1 * | 12/2010 | Preston-Powers | 2/422 |

* cited by examiner

*Primary Examiner* — Alissa Tompkins

(57) ABSTRACT

The present invention features a helmet 100 for cooling a head of a person. In some embodiments, the helmet comprises a top portion 110 covering the scalp region of the person's head, a neck portion 120 covering the neck region of the person's head, a tube 130 embedded in the helmet 100, wherein a circular portion 132 of the tube is disposed in the top portion to lay over the person's scalp region and a tail portion 134 of the tube runs down the neck region 120. Further, a first end of the tail portion 136 of the tube fluidly connects to the circular portion of the tube, and a second end of the tail portion 138 of the tube comprises a cap 140 that can open for drainage of a content in the tube. In some embodiments, a pressurized refrigerant container 150 fluidly connects to the tail portion 134 of the tube, wherein a pressurized refrigerant can be released into the tube when a first valve is opened.

1 Claim, 4 Drawing Sheets

HELMET FOR COOLING HEAD

BACKGROUND OF THE INVENTION

Helmets are worn by athletes in competition. Helmets are also worn by individuals in the construction field. During athletic competition or construction work, body heat is produced which may cause heat exhaustion. The performance of such activities in an environment where elevated temperatures prevail is known to cause or aggravate such condition.

The present invention features a helmet for cooling a head of a person.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
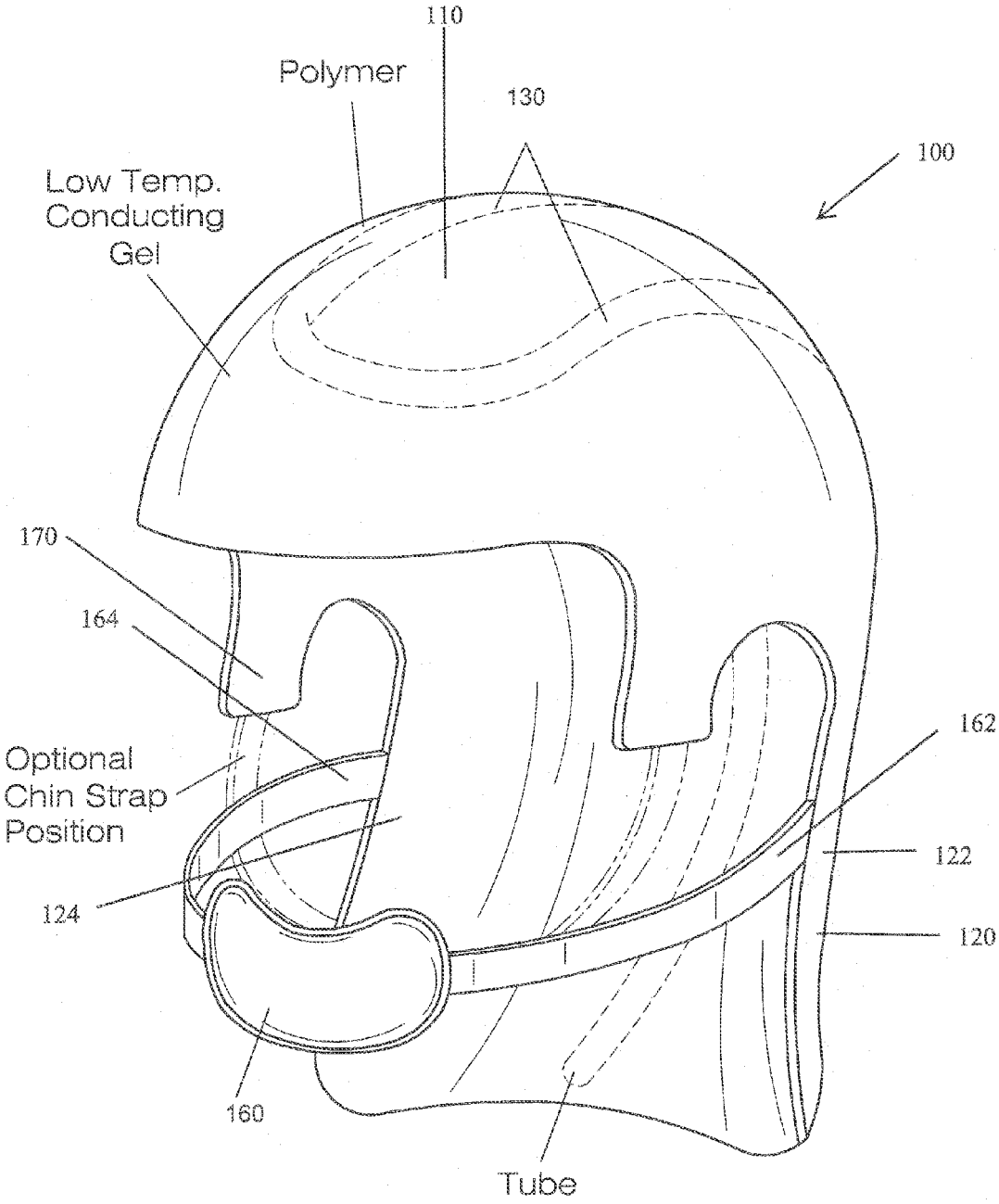
FIG. 1 is a perspective view of the helmet.
Figure 2:
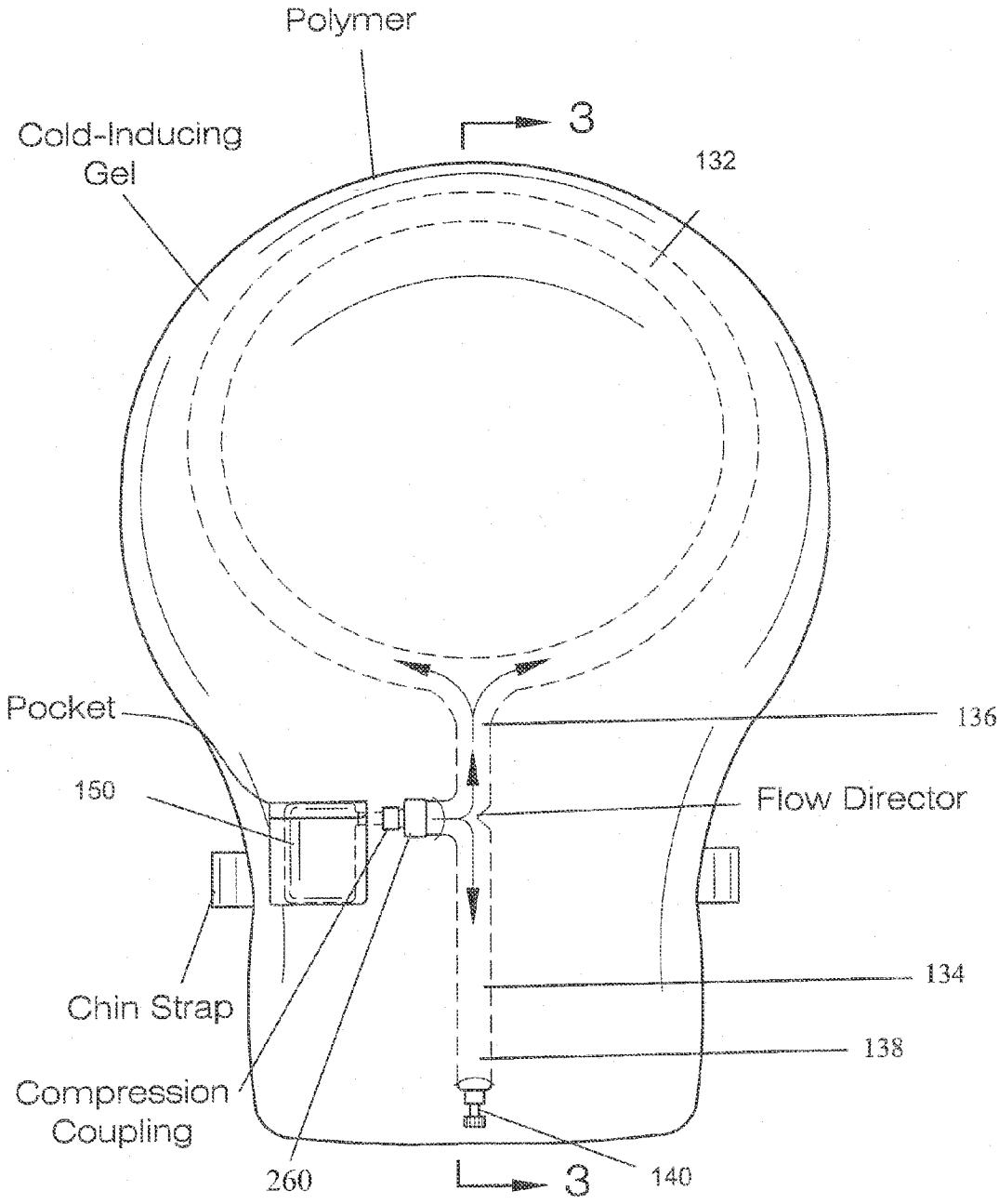
FIG. 2 is a back view of the helmet.
Figure 3:
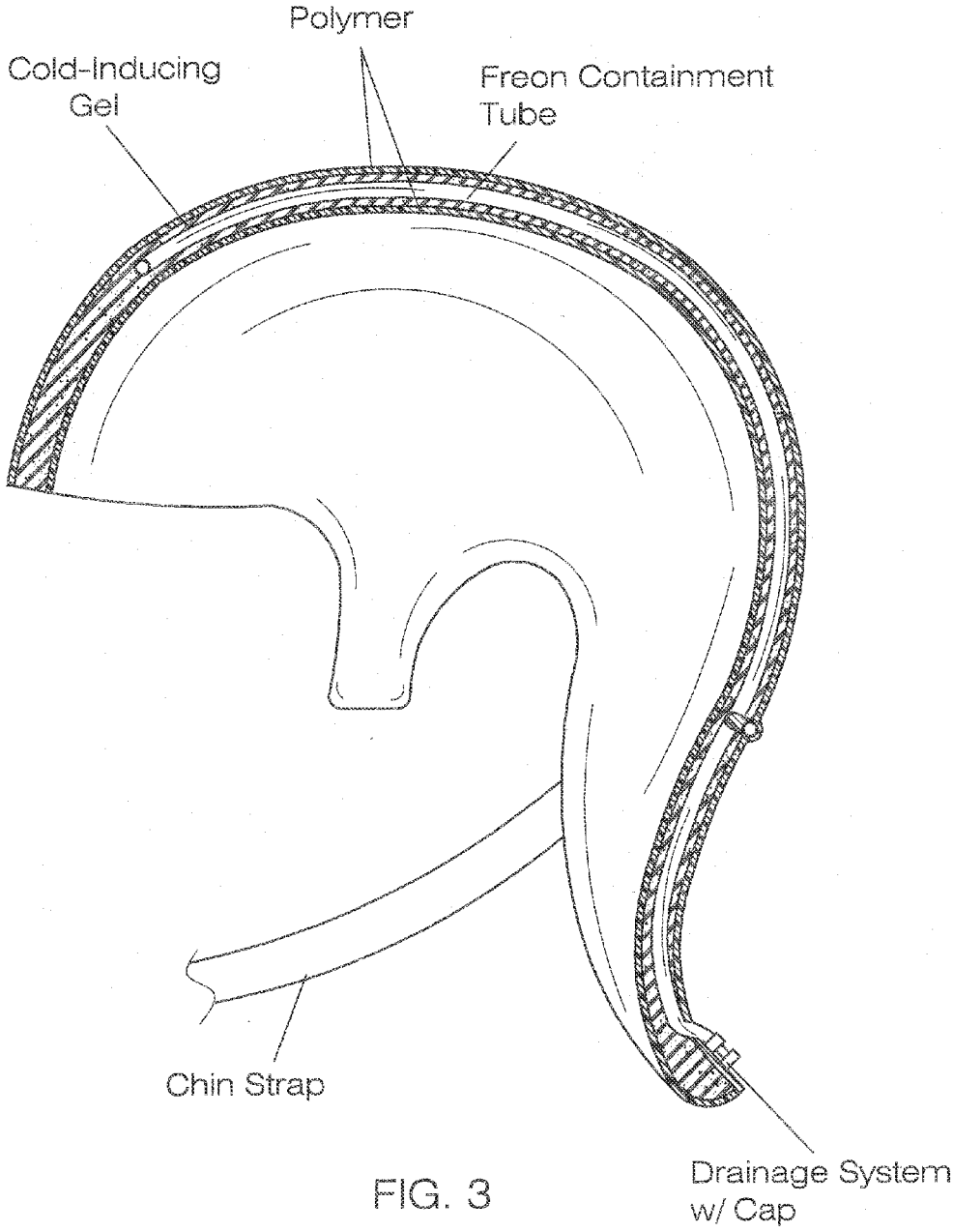
FIG. 3 is a side view of the helmet, showing the tube embedded in the skin of the helmet.
Figure 4:
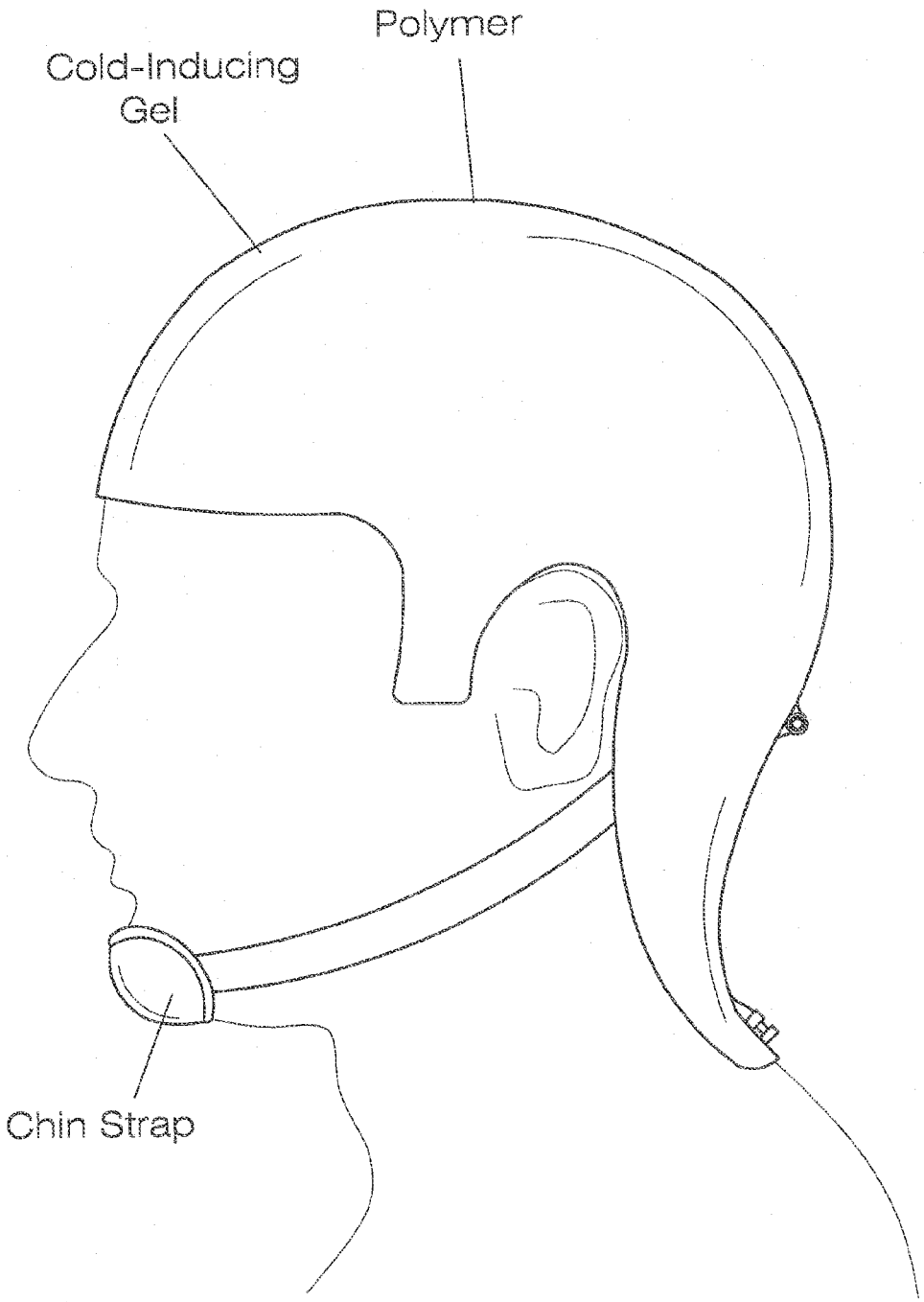
FIG. 4 IS another side view of the helmet.

Referring now to FIGS. 1-4, the present invention features a helmet 100 for cooling a head of a person. In some embodiments, the helmet comprises a top portion 110 covering the scalp region of the person's head, a neck portion 120 covering the neck region of the person's head, a tube 130 embedded in the helmet 100, wherein a circular portion 132 of the tube is disposed in the top portion to lay over the person's scalp region and a tail portion 134 of the tube runs down the neck region 120.

Further, a first end of the tail portion 136 of the tube fluidly connects to the circular portion of the tube, and a second end of the tail portion 138 of the tube comprises a cap 140 that can open for drainage of a content in the tube.

In some embodiments, a pressurized refrigerant container 150 fluidly connects to the tail portion 134 of the tube, wherein a pressurized refrigerant can be released into the tube when a first valve is opened. Without wishing to limit the invention to any particular theory of mechanism, the person's head is cooled when the pressurized refrigerant is released into the tube, the pressurized refrigerant absorbs a heat from the person's head and the pressurized refrigerant transforms into a warmed refrigerant, and the warmed refrigerant is drained from the tube. In some embodiments, the refrigerants comprise a dichlorodifluoromethane (e.g., Freon-12). After the warmed refrigerant is drained, the user can dose the cap 140 and open the first valve 260 from the pressurized container 150 to release more refrigerant into the tube for another round of cooling.

In some embodiments, the helmet further comprises a chin strap 160 with a first end 162 and a second end 164, wherein the first end being attached to a first side 122 of the neck portion of the helmet and the second end can be attached to a second side 124 of the neck portion of the helmet or to a side burn portion 170 of the helmet.

In some embodiments, the helmet is constructed from a heavy-gauge polymer. In some embodiments, the helmet is constructed from a low temperature conducting gel. In some embodiments, the helmet is constructed from a rubber. The tube may be constructed from any appropriate material, such as a polymer, rubber or light weight metal.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A helmet (100) for cooling a head of a person, the helmet consisting of:

(a) a top portion (110) covering a scalp region of the person's head;

(b) a neck portion (120) covering a neck region of the person's head;

(c) a tube (130) embedded in the helmet (100), wherein a circular portion (132) of the tube is disposed in the top portion to lay over a person's scalp region and a tail portion (134) of the tube runs down the neck region (120), a first end of the tail portion (136) of the tube fluidly connects to the circular portion of the tube, a second end of the tail portion (138) of the tube comprises a cap (140) that opens for drainage of a content in the tube;

(d) a pressurized refrigerant container attached to the neck region (150) fluidly connected to the tail portion (134) of the tube, wherein a pressurized refrigerant is released into the tube when a first valve (260) is opened;

wherein the person's head is cooled when the pressurized refrigerant is released into the tube, the pressurized refrigerant absorbs a heat from the person's head and the pressurized refrigerant transforms into a warmed refrigerant, and the warmed refrigerant is drained from the tube.

* * * * *